US006433321B1

(12) United States Patent
Lee et al.

(10) Patent No.: US 6,433,321 B1
(45) Date of Patent: Aug. 13, 2002

(54) MICROWAVE OVEN WITH HIGH-POWER OUTPUT SWITCHING MEANS

(75) Inventors: Sung-Ho Lee; Young-Won Cho, both of Suwon; Tae-Soo Kim, Seoul, all of (KR)

(73) Assignee: Samsung Electronics, Co. Ltd., Suwon (KR)

( * ) Notice: Subject to any disclaimer, the term of this patent is extended or adjusted under 35 U.S.C. 154(b) by 0 days.

(21) Appl. No.: 09/879,997

(22) Filed: Jun. 14, 2001

(30) Foreign Application Priority Data

Mar. 12, 2001 (KR) ..... 2001-12686

(51) Int. Cl.[7] ..... H05B 6/68

(52) U.S. Cl. ..... 219/715; 219/716; 219/718; 363/21

(58) Field of Search ..... 219/715, 716, 219/702, 718; 363/21, 17, 98, 97

(56) References Cited

U.S. PATENT DOCUMENTS 4,900,885 A * 2/1990 Inumada ..... 219/715
4,988,922 A * 1/1991 Shoda et al. ..... 315/223
5,124,518 A * 6/1992 Lee ..... 219/716
5,268,547 A * 12/1993 Bessyo et al. ..... 219/716
5,977,530 A * 11/1999 Bessho ..... 219/715
6,211,504 B1 4/2001 Lee ..... 219/757

* cited by examiner

*Primary Examiner*—Philip H. Leung
(74) *Attorney, Agent, or Firm*—Robert E. Bushnell, Esq.

(57) ABSTRACT

A microwave oven comprising a magnetron for generating a high frequency in response to a high voltage, a transformer having primary and secondary coils, the transformer generating the high voltage in a turn ratio of the primary and secondary coils and supplying it to the magnetron, and high-power output switching means for controlling the level of a voltage applied to the primary coil of the transformer. The microwave oven with the high-power output switching means can control its maximum power output level on the basis of an allowable amount of current supplied to a distribution board.

15 Claims, 3 Drawing Sheets

MICROWAVE OVEN WITH HIGH-POWER OUTPUT SWITCHING MEANS

BACKGROUND OF THE INVENTION

1. Field of the Invention

The present invention relates in general to microwave ovens, and more particularly to a microwave oven having high-power output switching means capable of controlling the maximum power output of the oven according to allowable current of a distribution board.

2. Description of the Prior Art

Microwave ovens are generally adapted to perform a cooking operation based on a super-high frequency, in a different manner from cooking equipment of an external heating type based on thermal conduction and thermal radiation. Such a conventional microwave oven comprises a super-high frequency oscillation tube, or a magnetron, for generating a super-high frequency of 2,450 MHz in response to high-voltage power applied thereto. The super-high frequency of 2,450 MHz generated from the magnetron causes an electric field to turn in direction at a rate of 2.45 billion times per second. Where this super-high frequency is applied to food, molecules of water in the food vibrate at a rate of 2.45 billion times per second while generating a large amount of heat, thereby cooking the food.

In the above-mentioned conventional microwave oven, allowable current is fixed at a predetermined value in a hardware manner, so the maximum power consumption of the microwave oven, related to the maximum power output thereof, is set to a certain value below power consumption based on the allowable current value.

For example, assuming allowable current of a home distribution board is 15A, microwave oven oscillatable current of about 13.8A is obtained by subtracting hood motor current consumption of about 0.6A and hood lamp current consumption of about 0.6A from the allowable current value. In this case, power consumption of the microwave oven is 1656 Watts if an input voltage is 120V and a power factor is 0.95. The maximum power output of the microwave oven is theoretically 950 Watts if efficiency is 60%.

In other words, in the conventional microwave oven, allowable current is fixed at a predetermined value in a hardware manner, thereby making it impossible for the microwave oven to output its maximum power higher than a predetermined value even though allowable current of a home distribution board is set to a greater value. That is, it is impossible for the microwave oven to change its maximum power output according to given situations.

SUMMARY OF THE INVENTION

Therefore, the present invention has been made in view of the above problem, and it is an object of the present invention to provide a microwave oven having high power output switching means capable of controlling the maximum power output of the oven according to allowable current of a distribution board.

In accordance with the present invention, the above and other objects can be accomplished by the provision of a microwave oven comprising a magnetron for generating a high frequency in response to a high voltage; a transformer having primary and secondary coils, the transformer generating the high voltage in a turn ratio of the primary and secondary coils and supplying a to the magnetron; and high-power output switching means for controlling the level of a voltage applied to the primary coil of the transformer.

BRIEF DESCRIPTION OF THE DRAWINGS

A more complete appreciation of the invention, and many of the attendant advantages thereof will be readily apparent as the same becomes better understood by reference to the following detailed description when considered in conjunction with the accompanying drawings in which like reference symbols indicate the same or similar components, wherein.

DETAILED DESCRIPTION OF THE PREFERRED EMBODIMENTS

Figure 1:
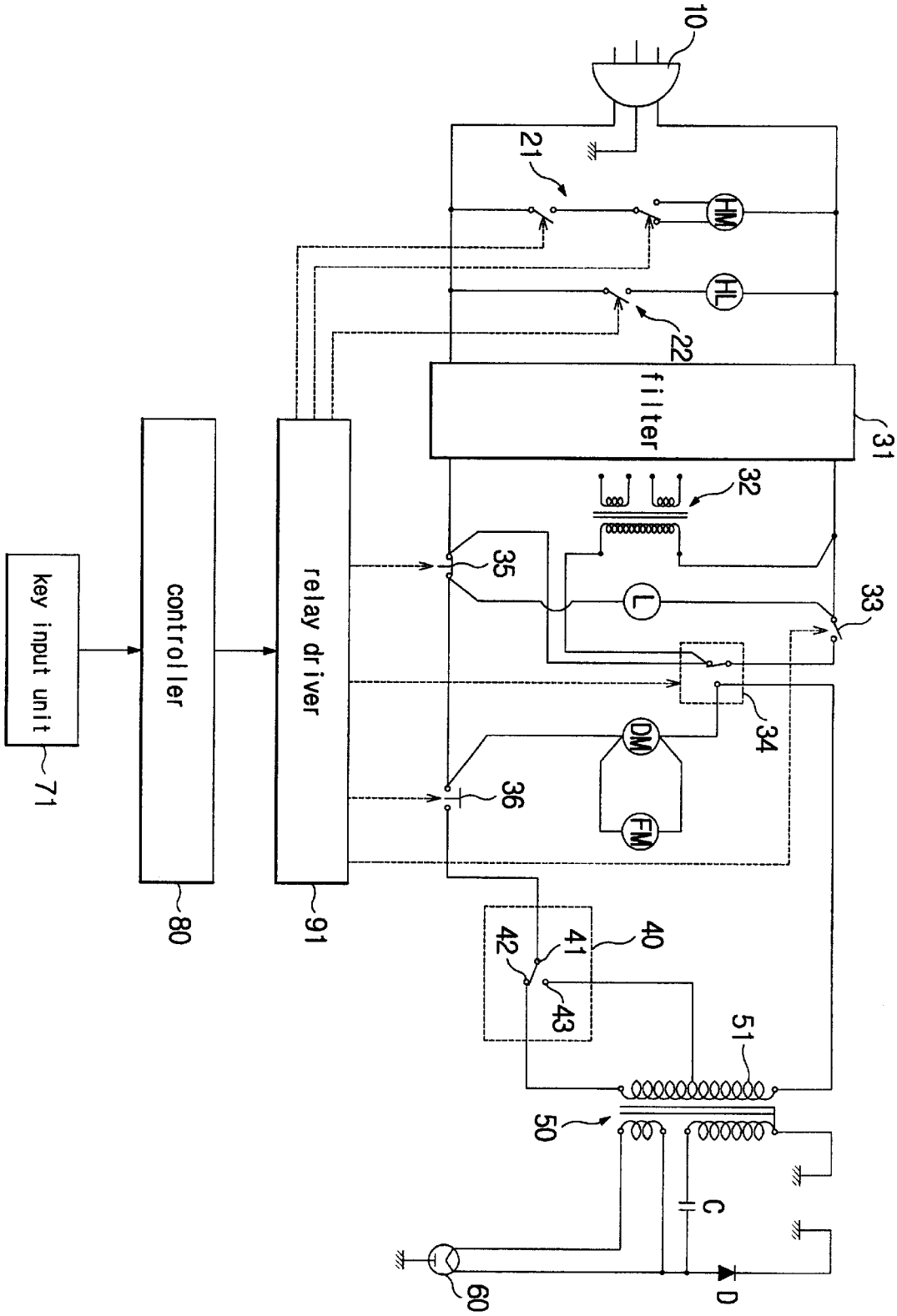
FIG. 1 is a circuit diagram showing the construction of a microwave oven with high-power output switching means in accordance with a first embodiment of the present invention.

FIG. 1 is a circuit diagram showing the construction of a microwave oven with high-power output switching means in accordance with a first embodiment of the present invention.

With reference to FIG. 1, the present microwave oven comprises a hood motor HM, a hood motor relay 21 for switching the operation of the hood motor HM, a hood lamp HL, and a hood lamp relay 22 for switching the operation of the hood lamp HL.

The microwave oven further comprises a controller 80 for controlling the entire operation of the oven, and a key input unit 71 connected electrically to the controller 80 for inputting an operation command from the user. The key input unit 71 inputs a variety of commands from the user and transfers them to the controller 80.

The microwave oven further comprises a filter 31 for removing noise from a signal of voltage from an electric cord 10, and a low-voltage transformer 32 for supplying low-voltage direct current (DC) power to the controller 80. The low-voltage transformer 32 is connected to the electric cord 10 via the filter 31 to receive the voltage from the cord 10 at its primary coil, step it down and apply the resulting low voltage to the controller 80.

A primary safety switch 33 is connected to a power line extending from the filter 31 at its one terminal to block or pass the supply of power from the electric cord 10 according to the opening or shutting of a door of the microwave oven. A monitor switch 34 is connected to the other terminal of the primary safety switch 33 to, when the switch 33 becomes out of order, operate in an opposite manner to the switch 33 so as to form a short circuit. A secondary safety switch 35 is connected to the other terminal of the primary safety switch 33 via the monitor switch 34 at its one terminal and to the one terminal of the switch 33 via a lamp L of a cooking cavity at its other terminal. The lamp L is turned on/off in response to ON/OFF operations of the secondary safety switch 35.

A power relay 36 is connected to the other terminal of the secondary safety switch 35, and a drive motor DM and cooling fan motor FM are connected between the power relay 36 and the monitor switch 34. Power output switching means 40 is connected between the power relay 36 and a primary coil 51 of a high-voltage transformer 50 whose one end is connected to the monitor switch 34. The power relay 36 acts to control the supply of power from the secondary safety switch 35 to the power output switching means 40.

The power output switching means 40 includes a switch having a plurality of contacts, a common contact 41 connected to a commercial alternating current (AC) power line via the power relay 36, a first contact 42 connected to the other end of the primary coil 51 of the high-voltage transformer 50, and a second contact 43 connected to an intermediate tap of the primary coil 51. The power output switching means 40, constructed in this manner, may preferably be provided at a certain position outside or inside of the microwave oven.

A high-voltage capacitor C and magnetron 60 are connected to a secondary coil of the high-voltage transformer 50, and a high-voltage diode D is in turn connected to the high-voltage capacitor C.

A detailed description will hereinafter be given of the operation of the microwave oven with the above-stated construction in accordance with the first embodiment of the present invention.

In case the microwave oven is installed under the condition that allowable current of a distribution board has a first value, for example, about 15A, the common contact 41 of the switch of the power output switching means 40 is connected to the first contact 42 thereof. If the common contact 41 is connected to the first contact 42, then the microwave oven is operated in a general power output mode where its power output is based on a certain value below the first allowable current value, namely, its maximum current consumption amounts to about 15A.

Alternatively, provided that the microwave oven is installed under the condition that the allowable current of the distribution board has a second value higher than the first value, for example, about 20A, the common contact 41 of the switch of the power output switching means 40 is connected to the second contact 43 thereof. Where the common contact 41 is connected to the second contact 43, the power output of the microwave oven is based on a certain value below the second allowable current value, namely, the maximum current consumption of the oven amounts to about 20A. As a result, the microwave oven provides its power output higher than that in the general power output mode.

Figure 2:
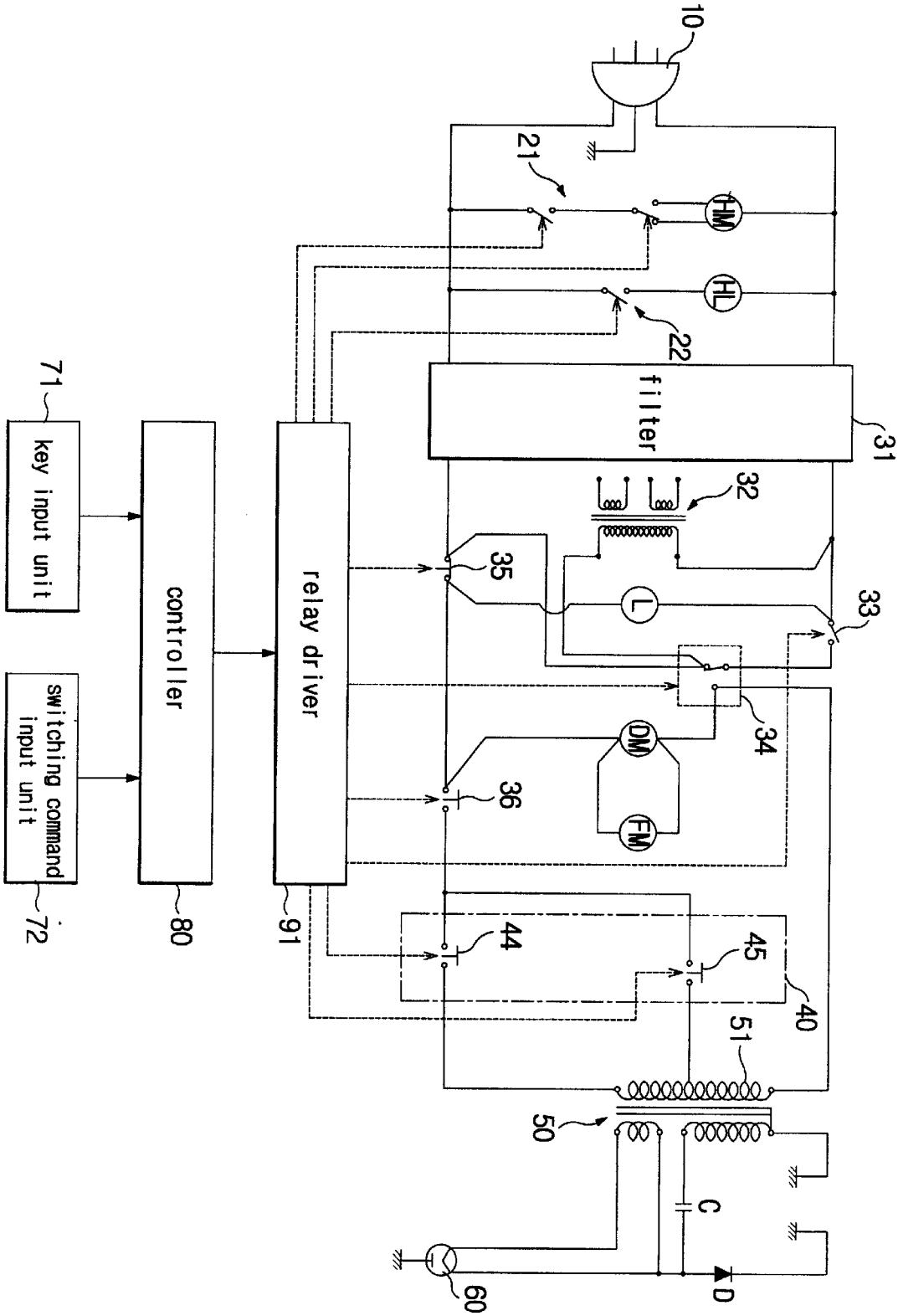
FIG. 2 is a circuit diagram showing the construction of a microwave oven with high-power output switching means in accordance with a second embodiment of the present invention.

FIG. 2 is a circuit diagram showing the construction of a microwave oven with high-power output switching means in accordance with a second embodiment of the present invention.

With reference to FIG. 2, the power output switching means 40 includes a pair of relays instead of the switch having the plurality of contacts, shown in FIG. 1. The microwave oven further comprises a switching command input unit for control of the relays.

In other words, a switching command input unit 72 is connected to the controller 80 to input a power output switching command and transfer it to the controller 80. The power output switching means 40 is connected between the commercial AC power line and the primary coil 51 of the high-voltage transformer 50 to perform a power output switching operation under the control of the controller 80.

The power output switching means 40 includes a first switching relay 44 connected between the commercial AC power line and the other end of the primary coil 51 of the high-voltage transformer 50, and a second switching relay 45 connected between the commercial AC power line and the intermediate tap of the primary coil 51. A relay driver 91 functions to drive the first and second switching relays 44 and 45 under the control of the controller 80.

Where the microwave oven is installed under the condition that the allowable current of the distribution board has a first value, for example, about 15A, the switching command input unit 72 inputs a power output switching command for selection of the general power output mode. Thus, the controller 80 controls the relay driver 91 in to response to the power output switching command inputted by the switching command input unit 72 to turn off the second switching relay 45 of the power output switching. means 40 and turn on the first switching relay 44 thereof. If the first switching relay 44 is turned on, then the microwave oven is operated in the general power output mode where its power output is based on a certain value below the first allowable current value, namely, its maximum current consumption amounts to about 15A.

Alternatively, in case the microwave oven is installed under the condition that the allowable current of the distribution board has a second value higher than the first value, for example, about 20A, the switching command input unit 72 inputs a power output switching command for selection of a high power output mode. Accordingly, the controller 80 controls the relay driver 91 in response to the power output switching command inputted by the switching command input unit 72 to turn off the first switching relay 44 of the power output switching means 40 and turn on the second switching relay 45 thereof. If the second switching relay 45 is turned on, then the microwave oven is operated in the high power output mode where its power output is based on a certain value below the second allowable current value, namely, its maximum current consumption amounts to about 20A. As a result, the microwave oven provides its power output higher than that in the general power output mode.

Figure 3:
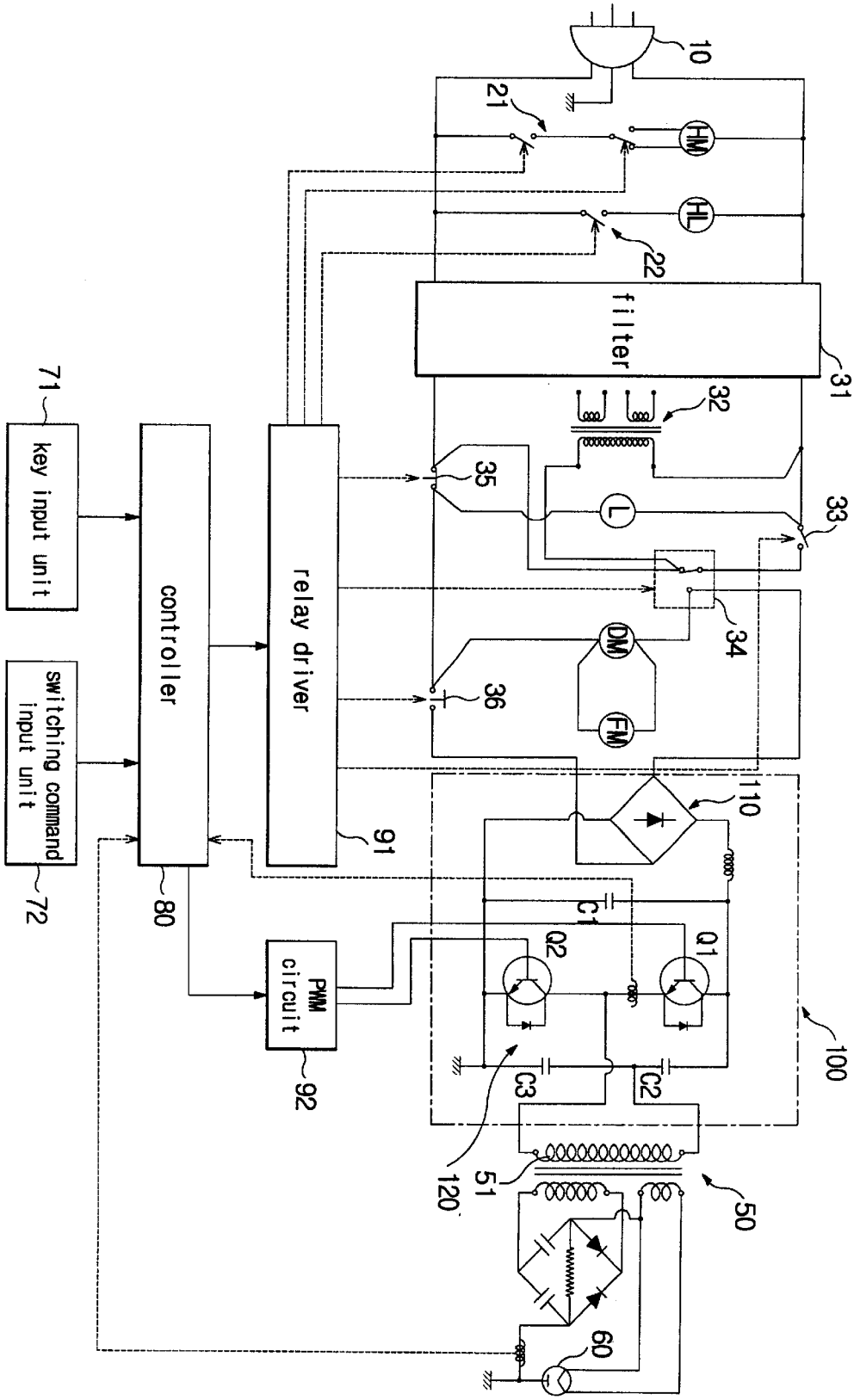
FIG. 3 is a circuit diagram showing the construction of a microwave oven with high-power output switching means in accordance with a third embodiment of the present invention.

FIG. 3 is a circuit diagram showing the construction of a microwave oven with high-power output switching means in accordance with a third embodiment of the present invention, wherein an inverter is provided as the switching means to perform a power output switching operation in response to a pulse width modulated signal.

As shown in FIG. 3, the present microwave oven comprises a hood motor HM, a hood motor relay 21 for switching the operation of the hood motor HM, a hood lamp HL, and a hood lamp relay 22 for switching the operation of the hood lamp HL.

The microwave oven further comprises a controller 80 for controlling the entire operation of the oven, and a key input unit 71 connected electrically to the controller 80 for inputting an operation command from the user. The key input unit 71 inputs a variety of commands from the user and transfers them to the controller 80.

The microwave oven further comprises a filter 31 for removing noise from a signal of voltage from an electric cord 10, and a low-voltage transformer 32 for supplying low-voltage DC power to the controller 80. The low-voltage transformer 32 is connected to the electric cord 10 via the filter 31 to receive the voltage from the cord 10 at its primary coil, step It down and apply the resulting low voltage to the controller 80.

A primary safety switch 33 is connected to a power line extending from the filter 31 at its one terminal to block or pass the supply of power from the electric cord 10 according to the opening or shutting of a door of the microwave oven. A monitor switch 34 is connected to the other terminal of the primary safety switch 33 to, when the switch 33 becomes out of order, operate in an opposite manner to the switch 33 so as to form a short circuit. A secondary safety switch 35 is connected to the other terminal of the primary safety switch 33 via the monitor switch 34 at its one terminal and to the one terminal of the switch 33 via a lamp L of a cooking cavity at its other terminal. The lamp L is turned on/off in response to ON/OFF operations of the secondary safety switch 35.

A power relay 36 is connected to the other terminal of the secondary safety switch 35, and a drive motor DM and cooling fan motor FM are connected between the power relay 36 and the monitor switch 34. The drive motor DM is driven to turn a turntable. Switching means 100 is connected between the power relay 36 and a primary coil 51 of a high-voltage transformer 50. The power relay 36 acts to control the supply of power from the secondary safety switch 35 to the switching means 100.

The switching means 100 includes a rectifier 110 for rectifying commercial AC power, and a switching circuit 120 for switching a DC voltage from the rectifier 110 to the primary coil 51 of the high-voltage transformer 50. To this end, the switching circuit 120 is provided with a plurality of switching devices.

Namely, the switching circuit 120 includes a first switching device Q1 and second switching device Q2 connected in series to the output of the rectifier 110. A first capacitor C1 is connected in parallel to the switching circuit 120. A second capacitor C2 and third capacitor C3 are connected in series to each other and in turn in parallel to the switching circuit 120.

A detailed description will hereinafter be given of the operation of the microwave oven with the above-stated construction in accordance with the third embodiment of the present invention.

Provided the microwave oven is installed under the condition that allowable current of a distribution board has a first value, for example, about 15A, a switching command input unit 72 inputs a power output switching command for selection of a general power output mode. Thus, the controller 80 controls a pulse width modulation (PWM) circuit 92 to control a duty ratio of the switching means 100 in the general power output mode.

Accordingly, the PWM circuit 92 controls switching operations of the first and second switching devices Q1 and Q2 in a predetermined general power output mode duty ratio under the control of the controller 80. As a result, the microwave oven is operated in the general power output mode where its power output is based on a certain value below the first allowable current value, namely, its maximum current consumption amounts to about 15A.

Alternatively, in case the microwave oven is installed under the condition that the allowable current of the distribution board has a second value higher than the first value, for example, about 20A, the switching command input unit 72 inputs a power output switching command for selection of a high power output mode. Hence, the controller 80 controls the PWM circuit 92 to control the duty ratio of the switching means 100 in the high power output mode.

Therefore, the PWM circuit 92 controls the switching operations of the first and second switching devices Q1 and Q2 in a predetermined high power output mode duty ratio under the control of the controller 80. As a result, the microwave oven is operated in the high power output mode where its power output is based on a certain value below the second allowable current value, namely, its maximum current consumption amounts to about 20A. Thus, the microwave oven provides its power output higher than that in the general power output mode.

As apparent from the above description, according to the present invention, the microwave oven with the high-power output switching means can control its maximum power output level on the basis of an allowable amount of current supplied to a distribution board.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A microwave oven comprising:

a magnetron for generating a high frequency in response to a high voltage;

a transformer having primary and secondary coils, said transformer generating said high voltage in a turn ratio of said primary and secondary coils and supplying said high voltage to said magnetron; and switching means for adjusting a level of a voltage applied to said primary coil of said transformer; and control means for controlling said switching means, said control means outputting a first power output switching signal where a first allowable current value of a power source is applied to the microwave oven, said control means outputting a second power output switching signal where a second allowable current value of a power source which is higher than said first allowable current value is applied to the microwave oven, whereby said switching means adjust the level of the voltage at a first voltage level in response to said first power output switching signal and adjust the level of the voltage at a second voltage level which is higher than said first voltage level in response to said second power output switching signal.

2. The microwave oven as set forth in claim 1, wherein said primary coil of said transformer has an intermediate tap between its one end and its other end, and wherein said high-power output switching means includes a switch, said switch having a common contact connected to a commercial alternating current (AC) power line, a first contact connected to said intermediate tap of said primary coil of said transformer, and a second contact connected to said other end of said primary coil.

3. The microwave oven as set forth in claim 1, wherein said primary coil of said transformer has an intermediate tap between its one end and its other end, wherein said high-power output switching means includes a first switching relay connected between a commercial AC power line and said intermediate tap of said primary coil of said transformer, and a second switching relay connected between said commercial AC power line and said other end of said primary coil, and wherein said microwave oven further comprises:

switching command input means for inputting a power output switching command;

said control means for outputting a power output switching signal in response to said power output switching command inputted by said switching command input means; and relay drive means for controlling switching operations of said first and second switching relays in response to said power output switching signal from said control means.

4. The microwave oven as set forth in claim 1, said microwave oven further comprising:

input means for inputting a power output switching command for said first and second power output switching signals.

5. The microwave oven as set forth in claim 1, said switching means comprising an inverter.

6. The microwave oven as set forth in claim 5, the microwave oven further comprising pulse width modulation means for controlling a duty ratio of a drive signal in accordance with said first and second power output switching signals.

7. The microwave oven as set forth in claim 6, said inverter comprising a rectifier, a first switching device, a second switching device, a first capacitor, a second capacitor and a third capacitor, said first and second switching devices being switched in response to said drive signal, said first and second devices connected in series to each other, said second and third capacitors connected in series to each other, the series connection of said first and second devices connected in parallel to said first capacitor, the series connection of said second and third capacitors connected in parallel to the series connection of said first and second switching devices, said primary coil having its one end connected to a connection point of said first and second switching devices and its other end connected to a connection point of said second and third capacitors.

8. The microwave oven as set forth in claim 7, wherein said first allowable current value is 15 amperes.

9. The microwave oven as set forth in claim 8, wherein said second allowable current value is 20 amperes.

10. A microwave oven comprising:

a magnetron for generating a high frequency in response to a high voltage;

a transformer comprising a primary coil and a secondary coil, said transformer generating said high voltage and supplying said high voltage to said magnetron;

an inverter for adjusting a level of a voltage applied to said primary coil, said inverter comprising a rectifier, a first and a second switching devices, and a plurality of capacitors, said first and said second switching devices connected in series to each other, said plurality of capacitors connected in series to each other, the series connection of said plurality of capacitors connected in parallel to the series connection of said first and said second switching devices, said primary coil having its one end connected to a connection point of said first and said second switching devices and its other end connected to a connection point of said plurality of said capacitors; and control means for controlling said inverter, said control means outputting a first power output switching signal where a first allowable current is supplied to the microwave oven, said control means outputting a second power output switching signal where a second allowable current is supplied to the microwave oven, said first and second switching devices being switched in response to said first and second power output switching signals, whereby the microwave oven has a first maximum power output level in response to said first power output switching signal and has a second maximum power output level in response to said second power output switching signal, and said second maximum power output level is higher than said first maximum power output level where a value of said second allowable current is higher than a value of said first allowable current.

11. The microwave oven as set forth in claim 10, further comprising pulse width modulation means for modulating pulse width of a drive signal to said inverter in accordance with said first and said second power output switching signals.

12. The microwave oven as set forth in claim 11, said inverter further comprising a smoothing circuit.

13. The microwave oven as set forth in claim 11, said microwave oven further comprising input means for inputting a power output switching command for said first and second power output switching signal.

14. A microwave oven comprising:

a magnetron for generating a high frequency in response to a high voltage;

a transformer comprising a primary coil and a secondary coil, said transformer generating said high voltage and supplying said high voltage to said magnetron; and an inverter for adjusting a level of a voltage applied to said primary coil, said inverter comprising a rectifier, a first switching device, a second switching device, a first capacitor, a second capacitor and a third capacitor, said first and second switching devices being switched in response to a drive signal, said first and second devices connected in series to each other, said second and third capacitors connected in series to each other, the series connection of said first and second devices connected in parallel to said first capacitor, the series connection of said second and third capacitors connected in parallel to the series connection of said first and second switching devices, said primary coil having its one end connected to a connection point of said first and second switching devices and its other end connected to a connection point of said second and third capacitors;

a controller outputting a first power output switching signal where a first allowable current is supplied to the microwave oven, said controller outputting a second power output switching signal where a second allowable current is supplied to the microwave oven; and pulse width modulation means for controlling a duty ratio of said drive signal to said inverter in response to said first and said second power output switching signals, whereby the microwave oven has a first maximum power output level in response to said first power output switching signal and has a second maximum power output level in response to said second power output switching signal, and said second maximum power output level is higher than said first maximum power output level where a value of said second allowable current is higher than a value of said first allowable current.

15. The microwave oven as set forth in claim 14, said microwave oven further comprising input means for inputting a first power output switching command for said first power output switching signal where said first allowable current is supplied to the microwave oven, said input means for inputting a second power output switching command for said second power output switching signal where said second allowable current is supplied to the microwave oven.

* * * * *